United States Patent [19]

Sterrett

[11] Patent Number: 4,756,383

[45] Date of Patent: Jul. 12, 1988

[54] MUFFLER WITH ADJUSTABLE BUSHING

[75] Inventor: Dale E. Sterrett, Grass Lake, Mich.

[73] Assignee: Tenneco Inc., Lincolnshire, Ill.

[21] Appl. No.: 844,310

[22] Filed: Mar. 26, 1986

[51] Int. Cl.[4] ..... F01N 1/08

[52] U.S. Cl. ..... 181/243; 181/266

[58] Field of Search ..... 181/236, 243, 253, 266, 181/271, 282, 241; 129/157 R

[56] References Cited

U.S. PATENT DOCUMENTS

| | | | |
|---|---|---|---|
| 1,995,840 | 3/1935 | Compo | 181/243 X |
| 2,382,159 | 8/1945 | Klemm | 181/241 |
| 3,145,800 | 8/1964 | Marx | 181/241 |
| 4,635,752 | 1/1987 | Jennings | 181/241 |

*Primary Examiner*—Benjamin R. Fuller

*Attorney, Agent, or Firm*—Harness, Dickey & Pierce

[57] ABSTRACT

An automotive muffler has an end header with two bushing receiving openings and is used with a gas flow bushing assembly comprising a bushing to fit in one of the openings and a flange to clamp the bushing to the header and cover the other opening in the header.

25 Claims, 5 Drawing Sheets

FIG. 1.
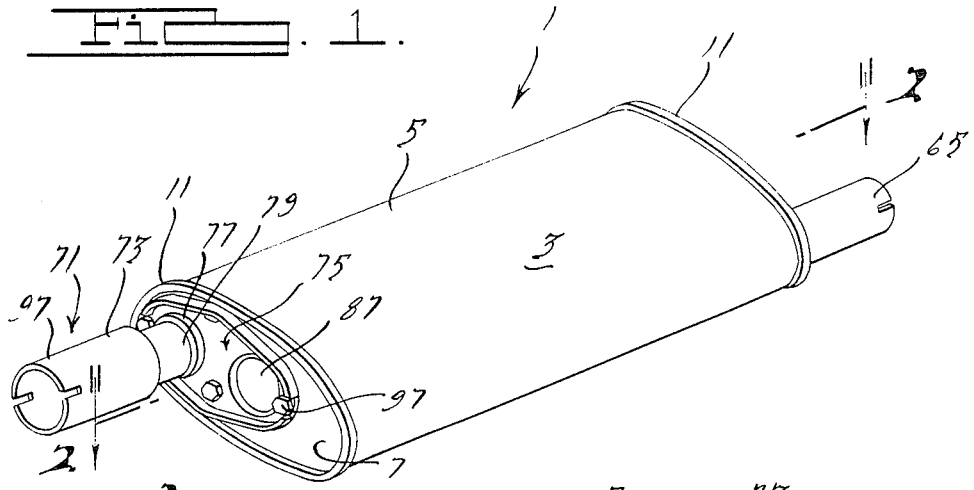
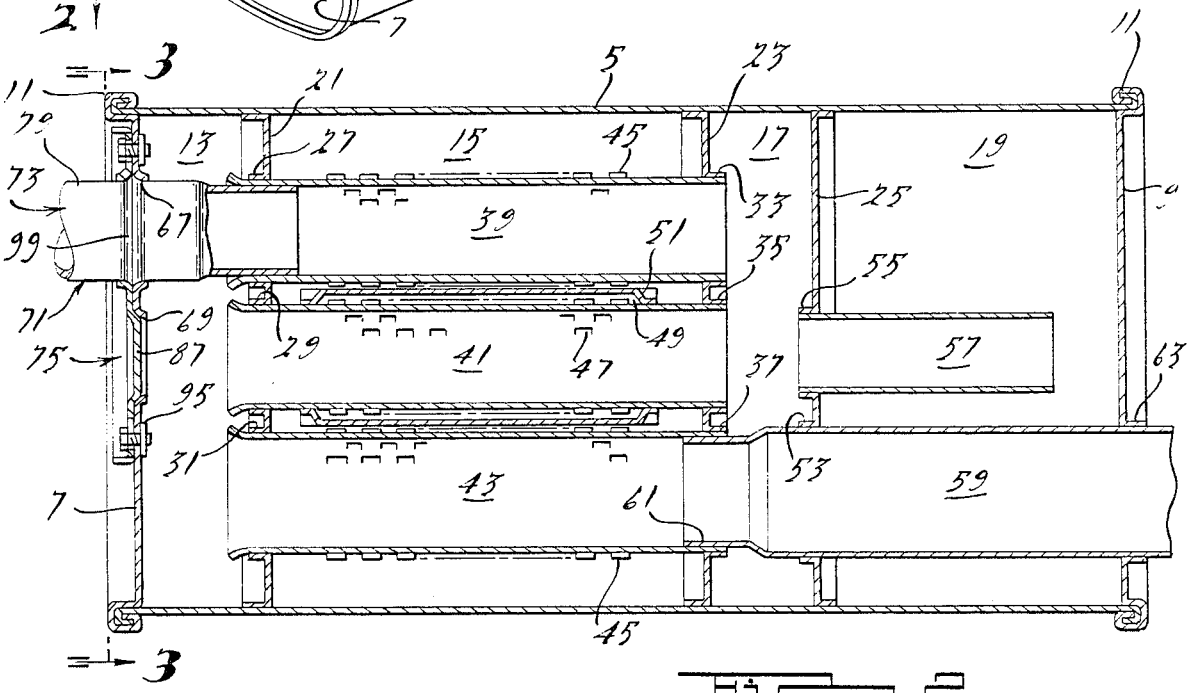
FIG. 2.
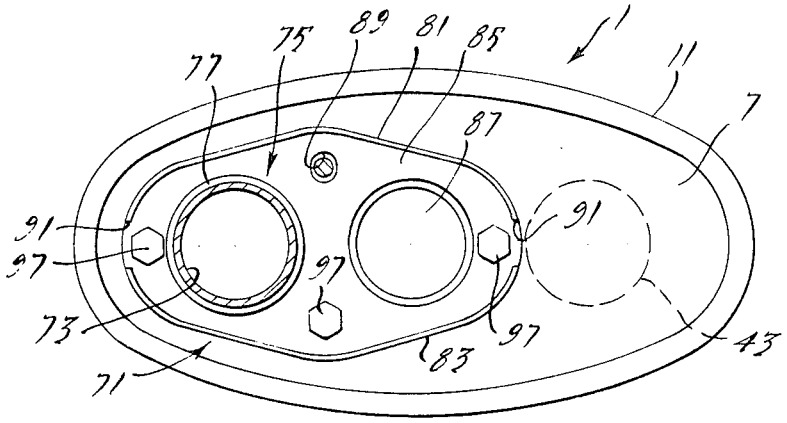
FIG. 3.
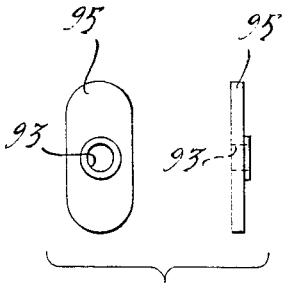
FIG. 4.

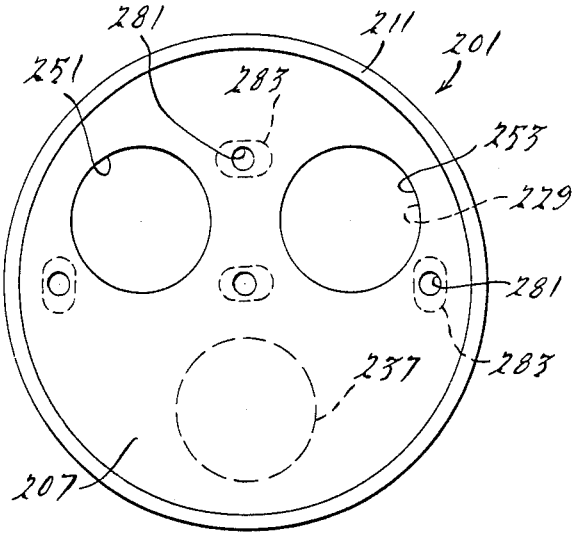
Fig. 13.
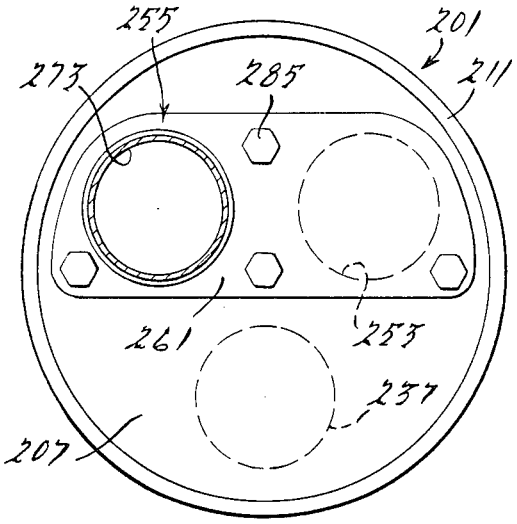
Fig. 14.
Fig. 16.
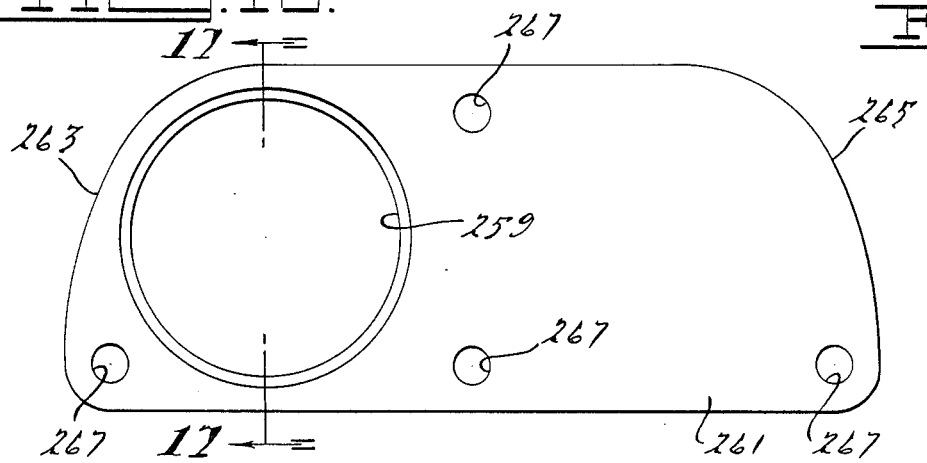
Fig. 17.
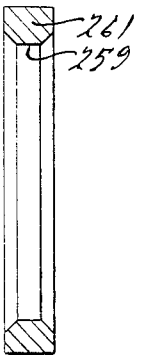
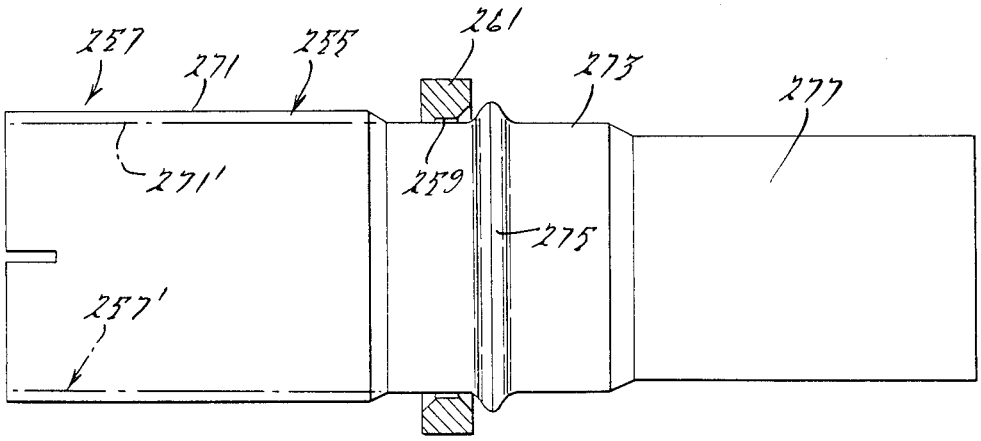
Fig. 18.

MUFFLER WITH ADJUSTABLE BUSHING

BACKGROUND OF THE INVENTION

This invention relates in general to sound attenuating mufflers. It is of particular value in connection with mufflers used in the exhaust systems of motor vehicles, especially automobiles and light trucks.

BRIEF SUMMARY OF THE INVENTION

It is a basic objective of the invention to provide a muffler construction that is particularly well suited for sale in the motor vehicle aftermarket in the form of replacement mufflers for original equipment ("O.E.") mufflers (i.e., those installed on the production lines of the motor vehicle manufacturers).

The invention accomplishes the foregoing objective by means of a muffler construction which has an inlet and/or outlet bushing that is adjustable so that it (or they) may be fixed in a selected one of a plurality of positions. In preferred form of muffler construction according to the invention, the header at one end of the muffler has two openings, either of which can receive a bushing. A bushing assembly, comprising a bushing and a flange, is bolted to the header with the flange over both openings. In this position the bushing is in whichever opening is selected and the flange closes the other opening. The nature of the structure is such that the bushing assembly can be attached (or detached) in the field, ordinarily in a repair shop when a muffler is being replaced.

In view of the great number of engine families and motor vehicle models that are on the road and the fact that O.E. mufflers and exhaust systems are usually identified by the motor vehicle manufacturers to suit one particular engine and vehicle model, a muffler repair shop would have to have access to an enormous inventory if it was necessary to replace each worn-out or damaged O.E. muffler and/or exhaust system with an identical part number. As a manufacturer of mufflers for the after-market, the assignee of the present invention has in the past addressed this problem and has consolidated acoustic features and external configurations so that, for example, 204 different O.E. part numbers are covered by only 36 different after-market or replacement mufflers, this representing current coverage of about 75% of domestic automobile and light truck registrations. By virtue of the present invention, this number (36) can be reduced to only 13 different mufflers to cover the 204 O.E. part numbers. The adjustable bushing concept of this invention is, therefore, a "universality" feature that enables one replacement muffler to be used in place of several different O.E. mufflers and makes it possible to substantially reduce the muffler inventory needed by repair shops. This should be reflected on the consumer level in better service and lower prices.

Other features, objects, and advantages of the invention will appear hereinafter.

DESCRIPTION OF THE DRAWINGS

FIG. 1 is a perspective view of an oval cross section automotive exhaust system muffler embodying the invention;

FIG. 2 is a longitudinal cross section through the muffler of FIG. 1 as taken along line 2—2 of FIG. 1;

FIG. 3 is an end elevation of the muffler of FIGS. 1 and 2 as taken at the left end of FIG. 2;

FIG. 4 is a detail composite plan view and side elevation of a threaded weld nut that may be used in the practice of the invention;

FIG. 14 is an elevation of the left end of the muffler of FIGS. 12 and 13;

FIG. 15 is an elevation similar to that of FIG. 14 but shows the muffler with the adapter flange and bushing assembly removed;

FIG. 16 is a plan elevation of the adapter of FIGS. 12, 13, and 14;

FIG. 17 is a cross section along line 17—17 through the adapter flange of FIG. 16;

FIG. 18 is a side elevation partly in section, of the adapter flange and bushing assembly of FIGS. 12–14;

DETAILED DESCRIPTION OF THE INVENTION

Figure 6:
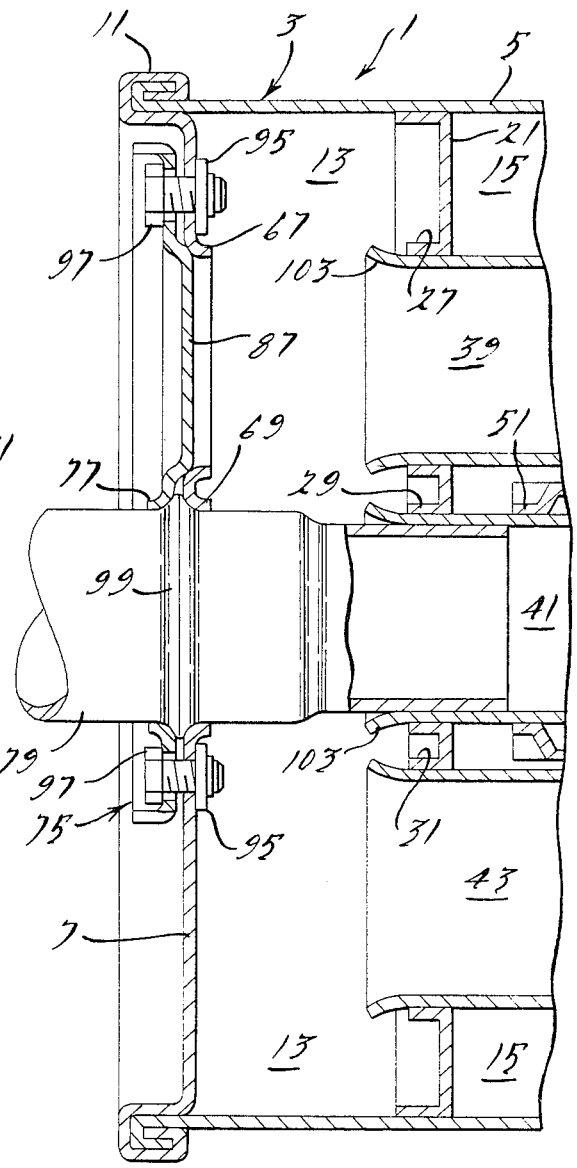
FIG. 6 is an enlarged cross section similar to FIG. 5 but shows the bushing in a second position.

Referring first to FIGS. 1 and 6, there is a tri-flow type muffler 1 which has a housing 3 that is composed of an elongated tubular sheet metal shell member 5 which is oval in cross-section and open at opposite ends. The left end of the shell member is closed by an end header 9. The sheet metal headers 7 and 9 are transverse with respect to the longitudinal axis of the elongated shell member 5 and their outer peripheries are each interlocked to the shell in a leakproof lock-seamed joint as seen at 11. The headers 7 and 9 and the shell member 5 form the muffler housing 3 and define an interior elongated space within the housing. This space is subdivided into a series of longitudinally adjacent sound attenuating chambers 13, 15, 17, and 19 by means of a trio of transverse sheet metal partitions 21, 23, and 25 which have outer circumferential flanges that are secured in longitudinal positions to the tubular shell member 5 by suitable means (not shown) such as spot welding.

The partition 21 is adjacent to the end header 7 and acts with it to define the chamber 13. It has a first opening in it defined by an annular collar 27; a second opening in it defined by another annular collar 29; and a third opening in it defined by a third annular collar 31; all collars extending in the direction of the end header 7. The partition 23, which acts with partition 21 to define the chamber 15, likewise has three openings through it. Thus, it has a first annular collar 33 defining a first opening; a second opening defined by a second annular collar 35; and a third opening defined by a third annular collar 37. The first openings in partitions 21 and 23 are in longitudinal alignment and support a first gas passage or flow tube 39. The second openings in partitions 21 and 23 are also in alignment and support, by way of collars 29 and 35, a second longitudinally extending gas flow tube 41. Similarly, the third collars 31 and 37 in partitions 21 and 23 and the openings defined by them are longitudinally aligned and receive and support a third longitudinally extending gas flow tube 43. The gas flow tubes 39 and 43 have louvers 45 extending through the walls of the gas flow tubes to open into the chamber 15 whereby sound in gas passing through these tubes may be attenuated by action of the louvers 45 and the chamber 15. The intermediate gas flow tube 41 also has louvers 47 in its wall but these open into a closed chamber 49 that is formed by a pancake-type shell 51 that extends around and is supported on the tube 41. Gas pulses in the intermediate tube 41 can only expand into the relatively small closed chamber 49 so that the louvers 47 in this chamber are designed to attenuate relatively high frequencies of sound whereas the action of the louvers 45 in tubes 39 and 43 in combination with the relatively large closed sound attenuating chamber 15 is intended to attenuate low to intermediate sound frequencies in the exhaust gases passing through the muffler.

The third partition 25 has a first opening in it, defined by an annular collar 53, and this is coaxial with the third gas passage tube 43. The partition 25 also has a second collar 55 defining a second opening that is illustrated as coaxial with the second gas passage tube 41. An elongated tuning tube 57 is mounted in the collar 55 and secured to it, as by spot welding, and projects into the chamber 19 which is formed between the transverse partition 25 and the end header 9. The length and cross sectional area of the tube 57 are selected in conjunction with the volume of chamber 19 to enable them to act together as a resonator chamber means to attenuate a preselected relatively low sound frequency.

A tube 59, shown as somewhat larger in diameter than the tube 43 with which it is aligned, is mounted in the collar 53 of partition 25 and has a reduced inner end 61 that fits within the end of the tube 43. The outer end of tube 59 is supported in and extends through an opening defined by an outwardly extending annular collar 63 formed in the end header 9. The outermost portion 65 of the tube 59 is located outside of the housing 5 and forms a gas flow bushing that may be connected in the usual manner to a gas flow conduit (not shown) in an exhaust gas system for an automobile or truck or simply for a combustion engine requiring silencing of the exhaust system.

The muffler construction so far described, as well as its operation and functioning, and the manner of assembling and manufacturing and assembling the various component parts are known and are described in various issued patents assigned to the assignee of this invention. They are also found in large numbers of mufflers previously manufactured and currently being manufactured for application in the exhaust systems of combustion engines.

In motor vehicles, the exhaust system usually includes a pipe that carries exhaust gas from the engine or catalytic converter into a bushing at the inlet end of a muffler and a pipe that conducts gas from a bushing at the outlet end of the muffler to a preselected point (such as the rear end of an automobile) for release to atmosphere. These pipes or gas flow conduits, are located in certain positions on the chassis of the vehicle and these positions are relatively fixed by means of hangers or other support means. Various other parts of the vehicle are contesting with components of the exhaust system for space beneath the vehicle; and it is the job of the vehicle designers to find room for all of them. The exact point at which gas enters the muffler and the exact point at which it leaves the muffler on any given model of automobile are pretty well predetermined. Therefore, if it is necessary to replace the O.E. muffler that was originally on the vehicle when it was shipped from the factory, the replacement muffler must not only be acceptable from a standpoint of acoustics (that is, it must do a satisfactory job of silencing noise in that particular exhaust system) but it must be configured to suit available space and its inlet and outlet bushings must be located so that they can be easily connected into the exhaust system of that specific vehicle model.

In accordance with this invention there is a means whereby one or the other or both the inlet and outlet bushings for a muffler may be attached in place or adjusted in the field after the muffler has been shipped from the factory. The illustrated embodiments of the invention have means whereby a bushing may be attached in either one of two different positions at the end of the muffler housing.

Referring to muffler 1, there are two bushing receiving openings in the header 7. The first opening is provided by an inwardly extending collar 67 that is formed in the header, and the second of the openings is provided by an inwardly extending collar 69 also formed in the header 7. The first opening 67 is in longitudinal alignment with the collar 27 in partition 21 and with the gas flow tube 39. Similarly, the second opening 69 is in longitudinal alignment with the collar 29 in partition 21 and with the gas flow tube 41. Thus, by blanking off one of the openings provided by collars 67 and 69 and inserting a gas flow bushing in the other of the opening, the muffler 1 will have a bushing in a selected one of two different positions.

A bushing assembly 71 provides means to secure a bushing in one of the openings 67 or 69 and to cover up the other of the openings. The assembly 71 comprises a tubular sheet metal gas flow bushing member 73 and a flange plate 75 which is shown as slidably mounted on the bushing 73. For this purpose, the flange 75 has an outwardly extending collar 77 which is similar to collars 67 and 69 through extending in the opposite direction. The gas flow bushing 73 has a reduced diameter central portion 79 which extends freely and slidably through the collar 77. The flange 77 is substantially oval in circumference, being very similar in overall shape to the oval cross-section of the tubular member 5, as can be seen in FIG. 3. It is preferably pressed or stamped out of sheet metal in such a way as to have a perpendicular flange around its top and a portion of its side edges as seen at 81 and a similar flange on the opposite or bottom edge as seen at 83. The substantially flat closed web portion 85 of the flange has an embossment 87 with a tapered periphery formed in it that is substantially the same size as the opening provided by the collar 77. The collar 77 and the embossment 87 are symetrically located in the closed section or web 85 of the flange so that when one is aligned with a collar 69, the other is aligned with the collar 67. Four symmetrically arranged bolt holes 89 are provided in the web 85 of the flange 75 and these are located adjacent the ends of the major and minor axes of the oval shape of the flange. The ends of the upper flange 81 and the lower flange 83 are spaced apart to provide openings 91 for wrenching purposes when tightening bolts that extend through openings 89.

Figure 5:
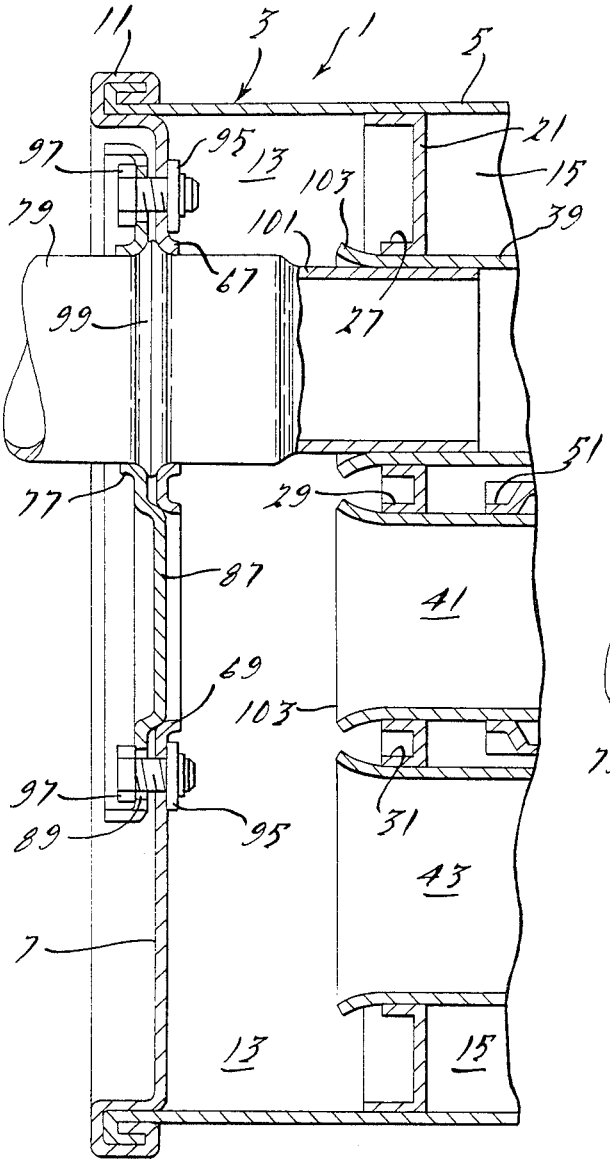
FIG. 5 is an enlarged broken away cross section at the left end of the muffler of FIG. 2 showing the bushing in one position.

When the flange 75 is positioned against the outside of the end header 7 so that the collar 77 and the embossment 87 are aligned with openings 67 and 69 in the end header, the bolt holes 89 are in alignment with threaded apertures 93 formed in extruded collars in stamped metal nut plates 95 that are welded in position on the inside face over bolt holes in the end header 7 as seen in FIGS. 2, 5, and 6, as well as in FIG. 4. The nut plates 95 receive the threaded ends of bolts 97 used to tightly clamp the flange 75 to the end header 7.

The gas flow bushing 73 has an outer end portion 97 which is larger in diameter than the flange collar 77 and which is located outwardly of the central bushing section 79. On the other side of the collar 77 and flange 75, the bushing has an annular rib 99 formed in it on a diameter which is slightly larger than the inner diameters of the collars 77, 67, and 69. The annular rib 99 is preferably tapered in cross section so that it conforms substantially to flares on collars 77, 67, and 69, these complementing flares on the mating collars forming, in effect, grooves or seats that receive the annular rib 99. Thus, when the bolts 97 are threaded tightly into the weld nuts 95, the rib 99 will be clamped tightly between the flange 75 and the end header 7, thereby also rigidly clamping the bushing 73 in place to the header. As can be seen, the joints are such as to resist gas leakage. However, gaskets (not shown) can also be used if desired.

The exact configuration of the bushing 73 can vary widely to suit specific applications. In the embodiment of FIGS. 1 to 6, the bushing has reduced diameter section 101 at the inner end of central section 79 which slidably fits inside the gas flow tube 39 (FIG. 5) or 41 (FIG. 6). The sliding fit of the bushing 73 in the ends of these tubes provides lateral support for the bushing assembly 71 to supplement the support provided at the clamp joint of rib 99 to header 7. As seen in the drawings, the ends of the tubes 39 and 41 are preferably flared outwardly at 103 to facilitate entry of the end section 101 of the bushing. In some embodiments (not shown), it may be desired to fit the end of the bushing 73 over the outside of a gas flow tube in which case it may be desirable to have a flare (not shown) at the end of section 101.

In functioning to attenuate sound in an exhaust gas system, and assuming that header 7 is at the inlet end of the muffler 1, the bushing 73 serves as the inlet connection for the muffler to receive and be circumferentially clamped to the outlet end of an exhaust pipe (not shown) so that gas flows through it into the gas flow tube 39. At the downstream end of tube 39, the gas enters transverse cross-over chamber 17 and reverses direction to enter the end of tube 41 and flow through it back toward header 7. Upon leaving tube 41 the gas enters cross-over chamber 13 and flows into tube 43 which carries it to tube 59, the outer end of which comprises, in this case, an outlet connection or bushing 65 that can receive and be circumferentially clamped to the inlet end of a tailpipe (not shown). If the bushing 65 serves as the inlet connection, flow through the muffler will be the reverse of that described. In either case, the various louvers, changes in cross section of the gas flow passage through the muffler, changes in flow direction, resonator chamber 19, etc., all serve to absorb acoustic energy and remove undesirable sound and noise from the exhaust gas.

If the bushing 73 is inserted in header opening 69 (FIG. 6), the flange 75 will be reversed end for end (i.e. rotated 180° about a centerline normal to web 85) so that tapered embossment 87 fits snugly in and closes opening 67. In this case the bushing 73 delivers exhaust gas to center tube 41 through which it flows to cross-over chamber 17. Here the gas reverses direction to enter tube 39 which functions as a return flow conduit to direct gas to cross-over chamber 13. The gas then enters outlet tube 43 to flow to tube 59 and outlet bushing 65.

The bushing assembly 71 can be attached to the header 7 at any desired point in the chain of manufacture, distribution, and sale. However, it would generally seem that benefits of the invention will be most fully realized if the assembly is attached at the repair shop to adapt a particular muffler to a particular vehicle or to serve as a bushing repair kit for a used muffler having a failed inlet or outlet bushing. Adding the bushing assembly 71 at the repair shop provides on-the-spot flexibility and by reducing the overall length of the muffler as shipped from the factory may effect some saving in packaging and shipping. As pointed out previously, use of the invention enables only 13 different mufflers to cover 204 O.E. part numbers. This coverage requires only 8 different bushing assemblies. It is therefore apparent that a significant reduction in inventory at the repair shop level can be achieved by means of the invention.

Figure 9:
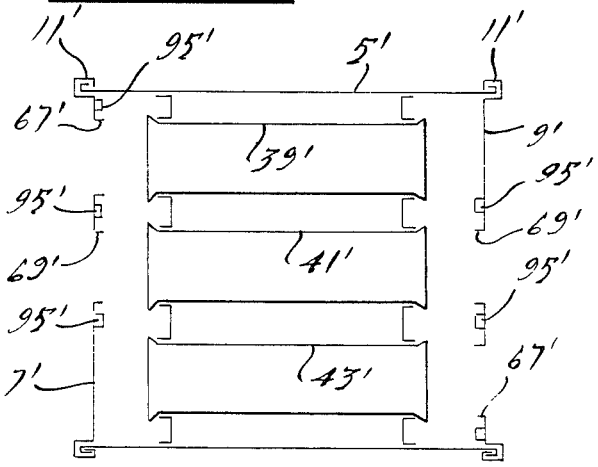
FIG. 9 is a schematic longitudinal cross section through another embodiment of automotive muffler that may be used with the adapter flange and bushing shown in previous Figures wherein adapter bushings are used at both ends of the mufflers.
Figure 10:
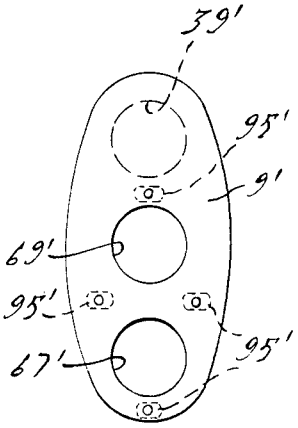
FIG. 10 is a schematic end elevation taken of the right end of the muffler of FIG. 9.
Figure 11:
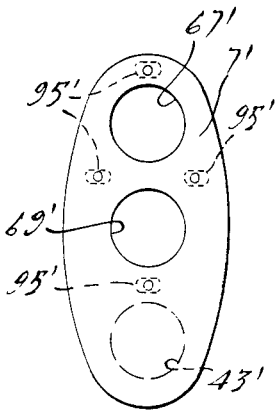
FIG. 11 is a schematic end elevation taken of the left end of the muffler of FIG. 9 and is substantially the same as FIG. 7.
Figure 7:
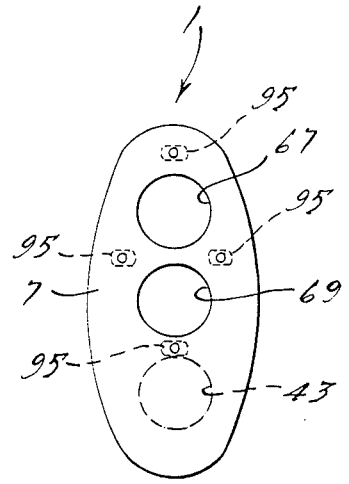
FIG. 7 is a schematic end elevation of the left end of the muffler of FIGS. 1 and 2 but shows how the muffler appears before the adapter flange and bushing assembly is bolted in place on the end header of the muffler.

FIGS. 9–11 illustrate in a schematic fashion a muffler 1' in which the resonator chamber 19 of muffler 1 is omitted and both ends are constructed to receive adapter bushing assemblies 71. Reference numbers with a prime attached indicate parts similar to those described in FIGS. 1–7. In muffler 1' the outer shell 5' is closed at opposite ends by flat, transverse end headers 7' and 9' which are lockseamed to the shell at 11'. A pair of transverse partitions in the shell 5' support the gas flow tubes 39', 41', and 43'. Each end header has a pair of openings defined by collars 67' and 69', the opening 67' in header 9' being located at the opposite end of the major axis from the opening 67' in header 7' as seen in FIG. 9 or by comparing FIGS. 9 and 10. The openings in header 7' are aligned with tubes 39' and 41' while the openings in header 9' are aligned with tubes 41' and 43'. Each header has four nut plates 95' on its inside face to provide means to receive bolts for clamping bushing assemblies 71 in place so that at each end the bushing 73 is in the desired tube and the embossment 87 closes the desired opening. With bushing assemblies in place at each end (not shown) a tri-flow gas passage through the muffler 1' can be obtained similar to that described for muffler 1. Generally speaking, the bushings at each end would not be simultaneously used in openings 69' since this would provide straight-through flow along tube 41' through the muffler.

Referring to FIGS. 12–19, the invention is illustrated in connection with a muffler 201 having a round cross section. The muffler 201 has a housing 203 composed of a sheet metal outer shell 205 which is closed at its left end by flat end header 207 and at its right end by end header 209, the headers being interlocked with the ends of shell 205 as seen at 211. The space within the housing 203 is subdivided into longitudinally adjacent transverse chambers 213, 215, 217, and 219 by three transverse sheet metal partitions 221, 223, and 225 which have outer circumferential flanges that are secured in longitudinal positions to the shell 205 by suitable means such as spot welding.

The partition 221 acts with the header 207 to define the chamber 213. It has a first opening in it defined by an annular collar 227; a second opening 229 (FIG. 15) in it defined by a second annular collar (not shown); and a third opening in it defined by a third annular collar 231; all collars extending in the direction of header 207. The partition 223 which acts with partition 221 to define chamber 215 also has three collared openings in it in longitudinal alignment with the openings in partition 221 and acting with them to support a first gas flow louver tube 233, a second or return gas flow louver tube 235, and a third gas flow louver tube 237. The three flow tubes 233, 235, and 237 are parallel and have axes that define corners of an equilateral triangle, as indicated in FIGS. 14 and 15, centered on the longitudinal axis of the muffler.

The partition 225 acts with partition 223 to define cross-over chamber 217 and has a collared opening 239 supporting tuning tube 241 connecting chamber 217 to otherwise closed resonator chamber 219. The partition 225 also has a collared opening 243 supporting an enlarged portion of imperforate tube 245 which is also supported in a collared opening 247 in header 209 and which has a reduced diameter inner end 249 fitting inside of the end of tube 237.

Figure 12:
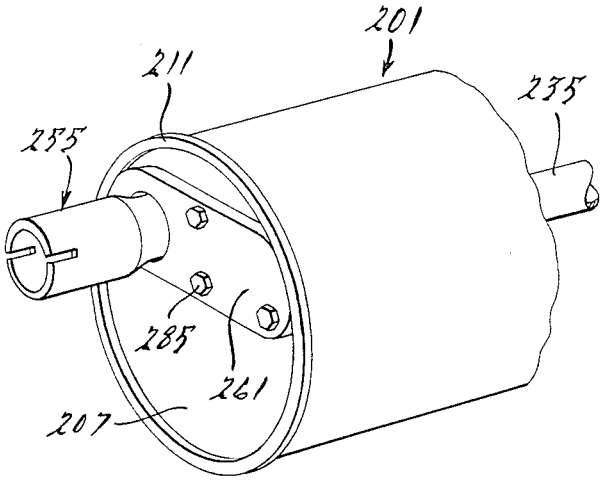
FIG. 12 is a perspective view of a round cross section automotive exhaust system muffler embodying the invention.
Figure 8:
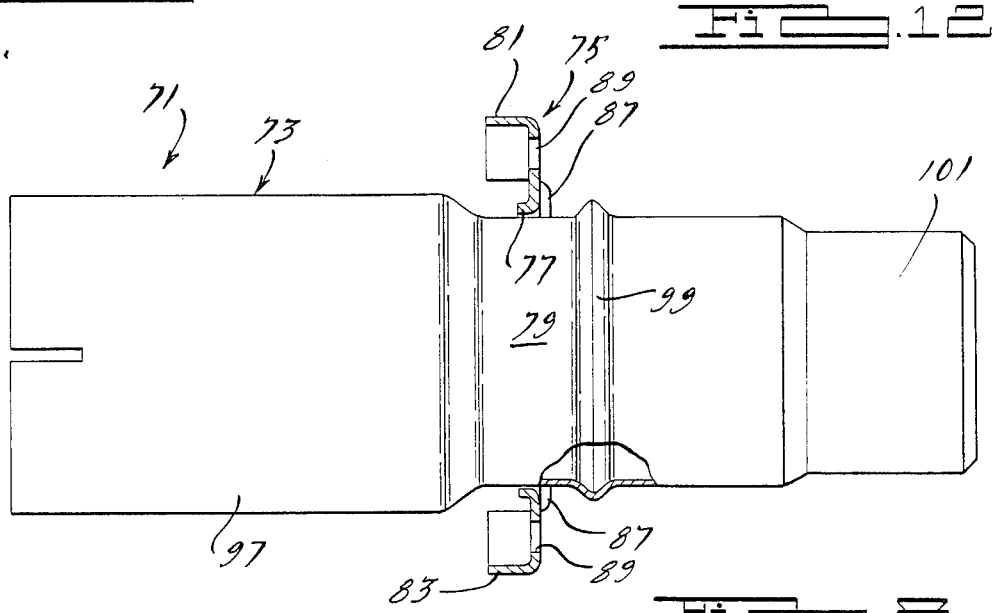
FIG. 8 is an enlarged side elevation, partly in section, of the adapter flange and bushing assembly before it is bolted in place on a header.
Figure 13:
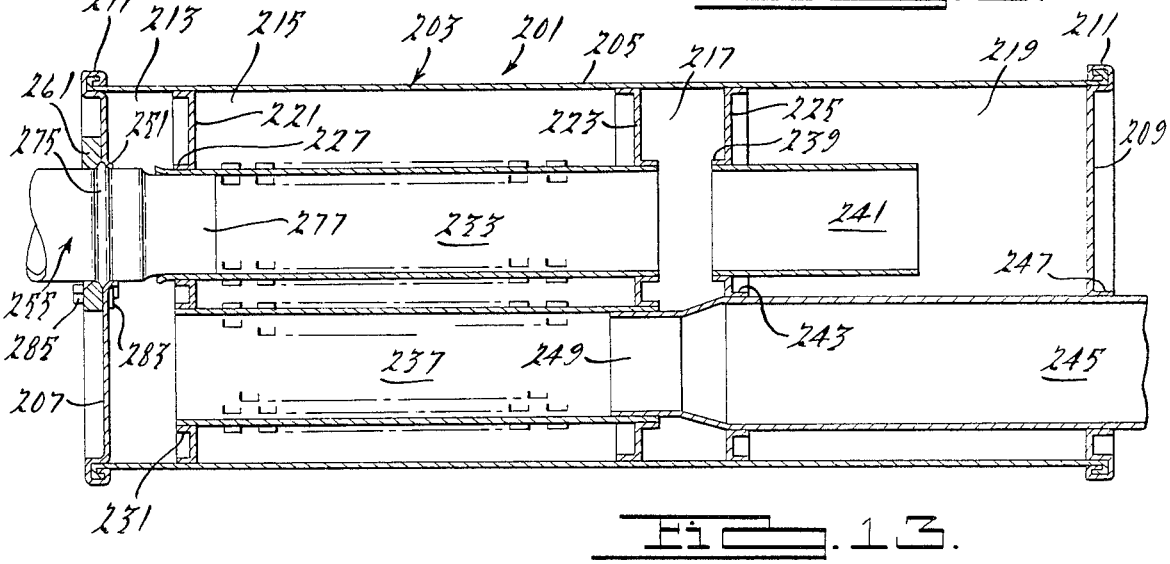
FIG. 13 is a longitudinal cross section through the muffler of FIG. 12.
Figure 19:
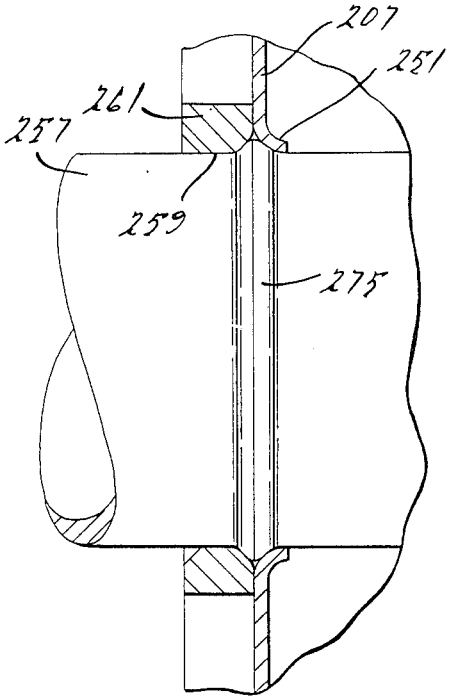
FIG. 19 is an enlarged cross section, broken away, showing the adapter flange of FIGS. 12–18 holding the bushing in place when it is bolted to the end header (clearance between the bushing and flange collar being omitted)

In line with the invention, the end header 207 has first and second inwardly flanged openings 251 and 253 (FIG. 15) in it, corresponding to openings 67 and 69 in muffler 1. Opening 251 is aligned with the flared outer end of tube 233 while opening 253 is aligned with the flared outer end (not shown) of tube 235. The openings are symmetrically positioned and located substantially on the same side of a diameter of the header. A bushing assembly 255 (FIG. 18) provides means to secure a bushing in one of openings 251 and 253 and to close the other. The assembly 255 comprises a tubular bushing member 257 slidably extending through an opening 259 (flared at each end) in a flange plate 261. The metal plate 261 is flat and substantially the same on both sides, relatively thick and of uniform thickness, and basically rectangular in configuration, though the ends are rounded as seen at 263 and 265 to flow with and parallel to the curvature of the annular lockseam 211 (FIGS. 12 and 14). The opening 259 is adjacent end 263 but the remainder of the plate, except for four bolt holes 267, is imperforate and therefore suitable to act as a closure means to close an opening 251 or 253.

Two forms of gas flow bushing are indicated in FIG. 18. In the full line form the bushing 257 (like bushing 73) has an outer end portion 271 that is larger in diameter than flange opening 259. In the phantom line form, the bushing 257' has an outer end portion 271' that will slide through opening 259. Each form of the bushing has a central portion 273 fitting through opening 259 and including an enlarged annular rib 275 (corresponding to rib 99) as well as a reduced diameter inner end 277 to fit inside the ends of tubes 233 and 235.

The end header 207 has four bolt holes 281 (FIG. 15) and on the inside face thereof are welded weld nuts 283, corresponding to weld nuts 95 described previously, and patterned to align with the bolt holes 267 in plate 261. By threading four bolts 285 through holes 267 and 281 and into the weld nuts 283, the plate 261 may be clamped to the header 207 with the enlarged annular rib 275 tightly seated between and in the flare in the end of plate opening 259 and the flare in the collar 251 or 253 (251 being shown in FIGS. 12, 13, and 14). This will enable the solid portion of plate 261 to be substantially flat against flat header 207 and to cover opening 253 while the bushing extends through opening 251 into the tube 233. Gasket means (not shown) may be used if desired for sealing purposes at openings 251 and 253.

If it is desired to adjust the position of the bushing so that it will extend into hole 253 and tube 235, there is a problem with the round muffler as compared with the oval mufflers of FIGS. 1–11. While the flange plate 75 of FIGS. 1–11 is symmetrical about both vertical and horizontal axes of its web, this is not true of plate 261 and it cannot be simply rotated 180° on the bushing to be used in either of two positions. Hence, a bushing assembly 255 with a bushing 257 having an enlarged outer end 271 so that the plate 261 is confined between it and the rib 261 can only be used for opening 251 and a different assembly will have to be used for opening 253. However, if a bushing assembly is used with a bushing 257' having an outer end 271' which is smaller than hole 259, the plate 261 being the same on both sides may be used for both openings 251 and 253. In this case, the plate 261 is taken off the bushing 257' and turned over (so ends 263 and 265 are interchanged in FIG. 16) and then placed back on the bushing 257', whereupon the flange may be bolted to header 207 with the bushing 257' in hole 253 and the end of tube 235 and the solid part of the flange covering hole 251.

The operation of muffler 201 to attenuate sound in exhaust gases is substantially the same as that described for muffler 1.

Figure 20:
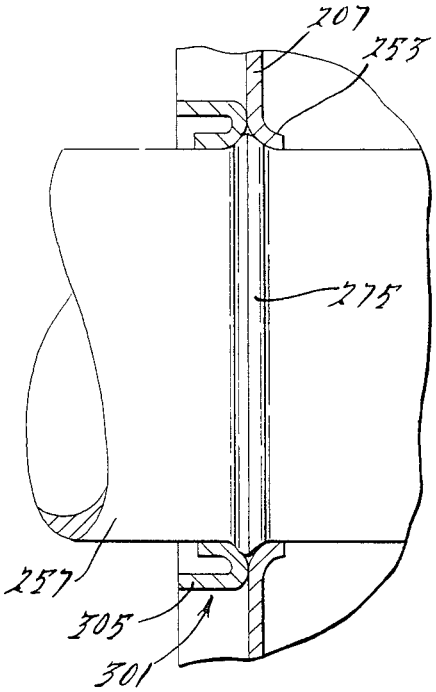
FIG. 20 is a section similar to FIG. 19 but showing a different form of adapter flange.
Figure 21:
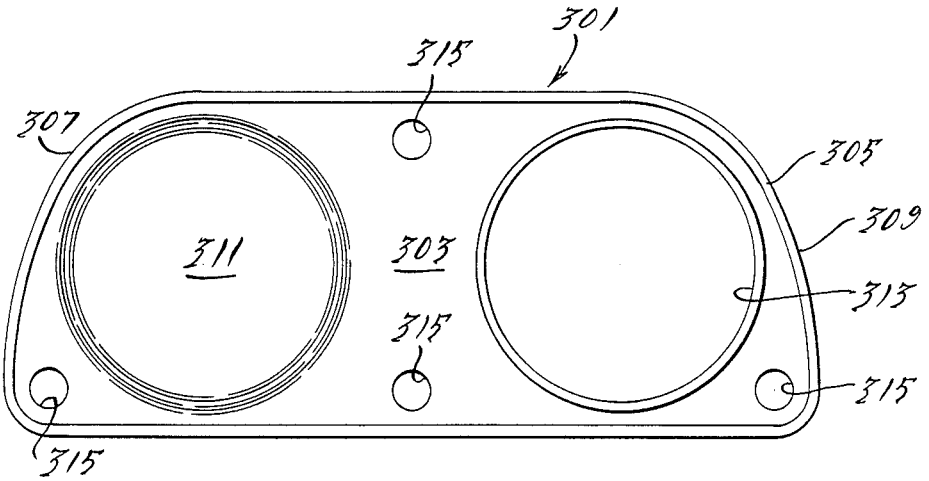
FIG. 21 is a plan view of the adapter flange of FIG. 20.
Figure 22:
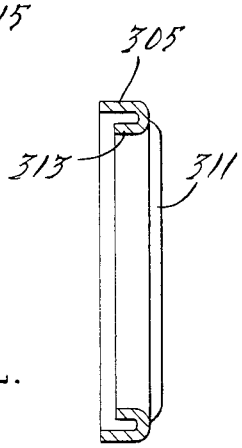
FIG. 22 is a cross section through the adapter flange of FIGS. 20–32.

FIGS. 20–22 illustrate a thin, stamped, sheet metal flange 301, which may be used in place of flange 261, if only one flange position per bushing assembly is acceptable. The flange comprises a member having a flat web 303 surrounded by a peripheral flange 305. The flange 301, like flange 261, is generally rectangular in configuration but has curved ends 307 and 309 (corresponding to ends 263 and 265) which follow the contour of the lockseam end 211 of the round muffler 201. The web 303 has an embossment 311 pressed into it to fit into and close opening 251 and a collared opening 313 to receive the central portion 273 of bushing 257. The web 303 also has a matching pattern of four bolt holes 315 to suit the layout of end header holes 281 and weld nuts 283 whereby the flange 301 may be bolted to the header to clamp a bushing 257 in place as previously described.

The invention, as described, provides means to "universalize" a muffler construction since the positions of the inlet and/or outlet bushings can be adjusted to suit specific applications. Modifications in the structures shown and described can be made without departing from the spirit and scope of the invention. For example, instead of nut plates 95, threaded studs could be welded to the headers to receive nuts that clamp the bushing assembly flanges to the headers.

I claim:

1. In a motor vehicle exhaust system type muffler comprising an elongated muffler housing, a transverse end header secured to and closing one end of the housing, said end header having first and second openings therein to receive gas flow bushings, a gas flow bushing, and a separate flange plate and bolt means for removably securing the bushing to the header with the bushing in one of the header openings.

2. A muffler as set forth in claim 1 wherein said flange plate and bolt means includes closure means as a part of the flange plate for closing the other of the header openings.

3. In a motor vehicle exhaust system type muffler comprising an elongated tubular muffler housing member, a transverse end header secured to and closing one end of the member, said end header having first and second openings therein to receive gas flow bushings, a gas flow bushing, separate plate means for removably securing the bushing to the header with the bushing in one of the first and second openings, said means as an integral portion thereof including closure means for closing the other of said first and second openings when said bushing is secured to the header.

4. A muffler as set forth in claim 3 wherein said separate means includes a flange plate and bolt means for securing the flange plate to the end header.

5. A muffler as set forth in claim 4 wherein said flange plate includes said closure means.

6. In a motor vehicle exhaust system type muffler comprising an elongated tubular muffler housing member, a transverse end header secured to and closing one end of the member, said end header having first and second openings therein to receive gas flow bushings, and a gas flow bushing assembly for clamping attachment to said end header comprising a gas flow bushing and a separate platelike flange, said flange and end header having cooperating clamp means whereby the flange may be clamped to the header in first and second predetermined positions, in said positions said flange extending over both the first and second openings in said header and having an opening aligned with one of said first and second openings and a closed portion aligned with and closing the other of said first and second openings, said bushing being located in said flange opening and having rib means of larger diameter than said flange opening and located between the flange and the header when the flange is clamped to the header whereby the flange clamps the rib means and therefore the bushing to the header.

7. In a motor vehicle exhaust system type muffler comprising an elongated tubular muffler housing member, a transverse end header secured to and closing one end of the member, said end header having first and second openings therein to receive gas flow bushings, and a bushing assembly for clamping attachment to said end header comprising a gas flow bushing and a separate platelike flange, said flange and end header having clamp means whereby the flange may be clamped to the header in a predetermined position, in said position said flange extending over both the first and second openings in said header and having an opening aligned with the first opening of the header and having a closure portion extending over and closing the second opening in the header, said bushing being located in said opening in said flange and having rib means of larger diameter than said flange opening and located between the flange and the header when the flange is clamped to the header whereby the flange clamps the rib means and therefore the bushing to the header.

8. In a motor vehicle exhaust system type muffler comprising an elongated tubular muffler housing member, a transverse end header secured to and closing one end of the member, said end header having first and second openings therein to receive gas flow bushings, and a bushing assembly for attachment to said end header comprising a gas flow bushing and a separate platelike flange, said flange and end header having cooperative fastening means whereby the flange may be securely attached to the headfer in a predetermined position, in said position said flange extending over both the first and second openings in said header and having an opening aligned with one opening of the header and having a closure portion extending over and closing the other opening in the header, said bushing being located in said flange opening and having rib means of larger diameter than said flange opening and located between the flange and the header when the flange is attached to the header in said position whereby the flange secures the rib means and therefore the bushing to the header.

9. A muffler as set forth in claim 8 wherein said cooperative fastening means of said flange and end header comprises threaded holes in said end header and openings in said flange aligned with said holes and adapted to receive bolts for threading into the holes to clamp the flange and bushing to the header.

10. A muffler as set forth in claim 8 wherein said bushing has a first portion of one diameter to extend through said flange opening and a second portion of larger diameter than said flange opening and located on the other side of said flange from said rib means whereby the flange is slidably confined on the bushing for movement between said first portion and said rib means.

11. A muffler as set forth in claim 10 wherein said cooperative fastening means of said flange and end header comprises threaded holes in said end header and openings in said flange aligned with said holes and adapted to receive bolts for threading into the holes to clamp the flange and bushing to the header.

12. A muffler as set forth in claim 11 wherein said end header has weld nuts secured to it to provide said threaded holes.

13. A muffler as set forth in claim 8 wherein said flange comprises a thin metal member having peripheral flange means and said closure portion comprises an embossment formed in said member and fitting in said header openings.

14. A muffler as set forth in claim 8 wherein said flange comprises a substantially flat and thick metal member having a solid imperforate section forming said closure portion.

15. A muffler as set forth in claim 8 wherein the openings in said header and said flange are flared to provide complementing grooves to receive said rib means when the flange is attached to the header.

16. A muffler as set forth in claim 8 wherein said housing member and header are oval in cross section and said flange is oval in cross section, said flange and the opening and closure portion thereof and said cooperative fastening means being substantially symmetrical about both the major and minor axes of the oval flange whereby the flange can be attached in a first position wherein its opening is aligned with the first opening in the header and its closure portion closes the second opening and in a second position wherein its opening is aligned with the second opening in the header and its closure portion closes the first opening.

17. A muffler as set forth in claim 8 wherein said housing member and header are round in cross section and said first and second openings in said header are located substantially on the same side of a diameter of the header, said flange being substantially rectangular in shape and having curved ends to substantially match the curvature of the periphery of the header.

18. A muffler as set forth in claim 17 wherein said flange comprises a flat part that is substantially the same on both sides whereby one side can be clamped to the header to hold the bushing in the first opening and the other side can be clamped to the header to hold the bushing in the second opening.

19. A muffler as set forth in claim 17 wherein said flange comprises a thin metal member having a peripheral flange and said closure portion comprises an embossment formed in said member and fitting in a header opening.

20. In a motor vehicle exhaust system type muffler comprising an elongated tubular muffler housing member, a transverse end header secured to and closing one end of the member, a transverse partition inside of said tubular member and secured to it and spaced longitudinally from said end header, said end header having first and second openings therein to receive gas flow bushings, said transverse partition having first and second openings therein to receive gas flow bushings, said first openings in said header and in said partition being longitudinally aligned, said second openings in said header and in said partition being longitudinally aligned, and a bushing assembly for attachment to said end header comprising a gas flow bushing and a separate platelike flange, said flange and end header having cooperative means whereby the flange may be securely attached to the header in a predetermined position, in said position said flange extending over both the first and second openings in said header and having an opening aligned with one of said openings of the header and having a closed portion extending over and closing the other of said openings in the header, said bushing having an intermediate portion extending through said opening in said flange, said bushing having an annular rib of larger diameter than said flange opening and located between the flange and the header when the flange is attached to the header in said position whereby the flange clamps the rib and therefore the bushing to the header, said bushing having an inner end portion extending from said annular rib into said tubular member and of greater length than the distance between said end header and said partition whereby the inner end of the bushing extends into one of said openings in the partition and is supported by said partition, said bushing having an outer end portion extending outwardly from said intermediate portion in a direction away from said header and adapted to be connected to a gas flow conduit.

21. A muffler as set forth in claim 20 wherein said outer end portion of the bushing is larger in diameter than said flange opening whereby the flange is slidably confined on the intermediate portion of the bushing.

22. In a motor vehicle exhaust system type muffler comprising an elongatged tubular housing member, a transverse end header secured to and closing one end of the member, first and second transverse partitions inside of said tubular member longitudinally spaced from each other and from said header, each partition having first and second openings therein, the first openings in the partitions being longitudinally aligned and the second openings in the partitions being longitudinally aligned, a first gas flow tube in said first openings and supported by said partitions, a second gas flow tube in said second openings and supported by said partitions, said end header having first and second openings therein to receive gas flow bushings, said first openings in said header and first partition being longitudinally aligned, said second openings in said header and second portion being longitudinally aligned, and a bushing assembly for attachment to said end header comprising a gas flow bushing and a separate platelike flange, said flange and end header having means whereby the flange may be securely attached to the header in a predetermined position, in said position said flange extending over both the first and second openings in said header and having a first opening aligned with one of the first and second openings of the header and having a closed portion extending over and closing the other of the openings in the header, said bushing having an intermediate portion extending through said opening in said flange and having an annular rib of larger diameter than said flange opening and located between the flange and the header when the flange is attached to the header whereby the flange clamps the rib and therefore the bushing to the header, said bushing having an inner end portion extending from said annular rib into said tubular housing member and of greater length than the distance between said end header and said first partition whereby the inner end of the bushing extends into one of said first and second gas flow tubes and is supported by it, said bushing having an outer end portion extending outwardly from said intermediate portion in a direction away from said header for connection to a gas flow conduit.

23. A motor vehicle exhaust system type muffler comprising an elongated tubular muffler housing member, a transverse end header secured to and closing one end of the member, a transverse partition inside of said tubular member and secured to it and spaced longitudinally from said end header, said end header having first and second openings therein to receive gas flow bushings, said transverse partition having first and second openings therein to receive gas flow bushings, said first openings in said header and in said partition being longitudinally aligned, said second openings in said header and in said partition being longitudinally aligned, said header having fastening means whereby a bushing and flange means may be attached to the header to cover one of said openings and hold a bushing in the other.

24. A motor vehicle exhaust system type muffler comprising an elongated tubular muffler housing member, transverse end headers secured to and closing each end of the member, transverse partitions inside of said tubular member and secured to it and spaced longitudinally inwardly from said end headers, each said end header having first and second openings therein to receive gas flow bushings, each said transverse partition having first and second openings therein to receive gas flow bushings, said first openings in each said header and in the adjacent one of said partitions being longitudinally aligned, said second openings in each said header and in the adjacent one of said partitions being longitudinally aligned, each end header having fastening means whereby a bushing and flange means may be attached to the header to cover one of said openings in the header and hold a gas flow bushing in the other.

25. A gas flow bushing and flange assembly for attachment to a motor vehicle exhaust system type muffler, said muffler including an elongated tubular muffler housing member, a transverse end header secured to and closing one end of the member, said end header having first and second openings therein to receive gas flow bushings, said end header having fastening means, said bushing and flange assembly comprising a gas flow bushing and a separate platelike flange, said flange having fastening means whereby the flange may be securely attached to the fastening means of the header in a predetermined position, in said position said flange being shaped to extend over both the first and second openings in said header and having an opening aligned with one of said openings of the header and having a closed portion to extend over and close the other of said openings in the header, said bushing having a portion extending through said opening in said flange, said bushing having an annular rib of larger diameter than said flange opening and located between the flange and the header when the flange is attached to the header in said position whereby the flange clamps the rib and therefore the bushing to the header, said bushing having a portion adapted to be connected to a gas flow conduit.

* * * * *